US012442379B2

(12) United States Patent
Mathias et al.

(10) Patent No.: US 12,442,379 B2
(45) Date of Patent: Oct. 14, 2025

(54) FAN DEVICE

(71) Applicant: SharkNinja Operating LLC, Needham, MA (US)

(72) Inventors: Richard Mathias, Wellesley, MA (US); Stephan James Godden, Woking (GB); Steven Bailey, Needham, MA (US)

(73) Assignee: SharkNinja Operating LLC, Needham, MA (US)

( * ) Notice: Subject to any disclaimer, the term of this patent is extended or adjusted under 35 U.S.C. 154(b) by 0 days.

(21) Appl. No.: 18/819,208

(22) Filed: Aug. 29, 2024

(65) Prior Publication Data

US 2025/0075704 A1 Mar. 6, 2025

Related U.S. Application Data

(60) Provisional application No. 63/536,001, filed on Aug. 31, 2023.

(51) Int. Cl.

| | |
|---|---|
| ***F04D 29/60*** | (2006.01) |
| ***F04D 19/00*** | (2006.01) |
| ***F04D 25/06*** | (2006.01) |
| ***F24F 5/00*** | (2006.01) |

(52) U.S. Cl.

CPC ..... *F04D 19/002* (2013.01); *F04D 25/0673* (2013.01); *F04D 29/601* (2013.01); *F24F 5/0035* (2013.01)

(58) Field of Classification Search

CPC .. F04D 19/002; F04D 25/0673; F04D 29/601; F04D 25/10; F04D 25/08; F04D 25/105; F04D 29/646; F24F 1/005; F24F 1/0029; F24F 5/0035

See application file for complete search history.

(56) References Cited

U.S. PATENT DOCUMENTS 5,435,696 A * 7/1995 Cunning ..... F04D 29/601 416/246

FOREIGN PATENT DOCUMENTS

| | | |
|---|---|---|
| CN | 208686628 U | 4/2019 |
| CN | 210106209 U | 2/2020 |
| WO | 2021223601 A1 | 11/2021 |

OTHER PUBLICATIONS

International Search Report and Written Opinion received for PCT Application No. PCT/US2024/036780, mailed on Oct. 18, 2024, 11 pages.

* cited by examiner

*Primary Examiner* — Aaron R Eastman
(74) *Attorney, Agent, or Firm* — Mintz, Levin, Cohn, Ferris, Glovsky and Popeo, P.C.

(57) ABSTRACT

A fan device having a first pedestal configuration and a second table-top configuration is provided. In one embodiment, the fan device includes a head assembly having a fan and a motor operatively coupled to the fan. The head assembly can also include an articulation mechanism and a plurality of legs coupled to the articulation mechanism. The fan device can further include a base assembly having a base and a support with a first end coupled to the base and a second end opposite the first end. The support can include a housing and an elongate receiving portion arranged within the housing at the second end of the support. The receiving portion can be configured to receive the plurality of legs to detachably couple the head assembly to the base assembly.

20 Claims, 13 Drawing Sheets

FAN DEVICE

CROSS-REFERENCE TO RELATED APPLICATIONS

This present application claims priority to U.S. Provisional Patent Application No. 63/536,001 entitled "Fan Device" filed on Aug. 31, 2023, which is hereby incorporated herein by reference in its entirety.

FIELD

A motorized fan for generating an air flow is provided.

BACKGROUND

Motorized fans can generate air flow within an environment in which the motorized fan is located. Motorized fans can include a fan with fan blades that is driven by a motor coupled to a power supply. A motorized fan can include electrical components configured to control operation of the motor such that the fan can generate the air flow at different speeds. The motorized fan can also include positioning components configured to position the motorized fan and direct the generated air flow as desired within the surrounding environment.

SUMMARY

In general, a fan device is provided for use in generating an air flow. In one embodiment, the fan device can include a head assembly including a fan and a motor operatively coupled to the fan. The head assembly can include an articulation mechanism and a plurality of legs coupled to the articulation mechanism. The fan device can also include a base assembly detachably coupled to the head assembly, the base assembly including a base and a support having a first end coupled to the base and a second end opposite the first end. The support can include a housing and an elongate receiving portion arranged within the housing at the second end of the support. The receiving portion can be configured to receive the plurality of legs to detachably couple the head assembly to the base assembly.

In some embodiments, the head assembly can include at least one of a rechargeable battery and a first DC power supply and the base assembly includes a second DC power supply. In some embodiments, the second DC power supply is configured to provide power to the head assembly when the head assembly is coupled to the base assembly.

In some embodiments, the receiving portion can include a pair of opposing surfaces forming a guide path there between extending from the first end toward a notch at a second end of the receiving portion. In some embodiments, a first surface of the pair of opposing surfaces can be oriented in a first rotational direction configured to cause the head assembly to rotate in the first rotational direction when the head assembly is coupled to the base assembly and a second surface of the pair of opposing surfaces can be oriented in a second rotational direction, opposite the first rotational direction. The second surface can be configured to cause the head assembly to rotate in the second direction when the head assembly is coupled to the base assembly.

In some embodiments, at the least one leg can include a protrusion thereon configured to translate along at least one surface of the pair of opposing surfaces in the guide path causing the protrusion to be received within the notch. In some embodiments, the at least one leg can further include an attachment mechanism configured to be received within an opening of the housing when the head assembly is coupled to the base assembly.

In some embodiments, the plurality of legs can include 3, 4, or 5 legs. In some embodiments, the articulation mechanism can include a plurality of gears configured to cause the plurality of legs to actuate in unison from a stored position to a extended position responsive to actuating at least one leg of the plurality of legs in the stored position. In some embodiments, the head assembly can further include a detachable misting unit.

DESCRIPTION OF DRAWINGS

These and other features will be more readily understood from the following detailed description taken in conjunction with the accompanying drawings.

Figure 1A:
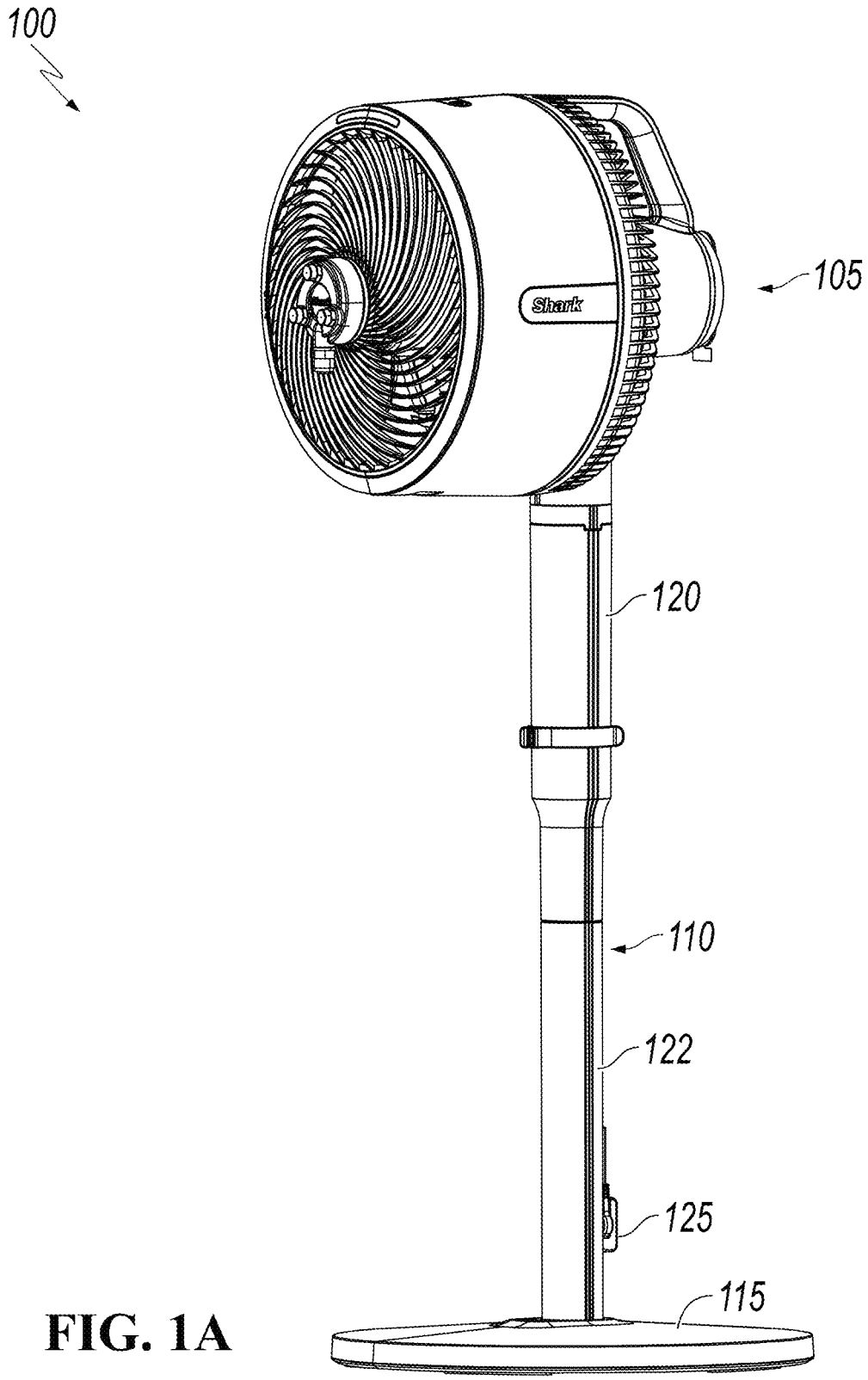
FIG. 1A is a front perspective view of one exemplary embodiment of a fan device including a detachable head assembly and a base assembly described herein.

It is noted that the drawings are not necessarily to scale. The drawings are intended to depict only typical aspects of the subject matter disclosed herein, and therefore should not be considered as limiting the scope of the disclosure.

DETAILED DESCRIPTION

Certain exemplary embodiments will now be described to provide an overall understanding of the principles of the structure, function, manufacture, and use of the devices and methods disclosed herein. One or more examples of these embodiments are illustrated in the accompanying drawings. Those skilled in the art will understand that the devices and methods specifically described herein and illustrated in the accompanying drawings are non-limiting exemplary embodiments and that the scope of the present invention is defined solely by the claims. The features illustrated or described in connection with one exemplary embodiment may be combined with the features of other embodiments. Such modifications and variations are intended to be included within the scope of the present invention.

Various exemplary fan devices are provided herein. In general, a fan assembly is provided that has two configurations, one in which the fan is designed as a standing unit and the other in which the fan is configured for a table-top arrangement. As explained further below, the fan device can generally include a fan head assembly having a removable base assembly. The base assembly can have a generally elongate configuration and can be configured to rest on a surface such as a floor at a location where fan device is to be operated. When a table-top configuration is desired, the fan head assembly can be detached from the base assembly so that the fan head assembly can be positioned separately from the base assembly. A plurality of legs can be provided on the fan head assembly and can be extended to maintain the fan head assembly in an upright position.

The fan device described herein includes a number of advantageous features which can enhance the usability and positioning of the fan device in a number of locations where traditional fans may not be configured for operation. As indicated above, in a first configuration the fan head assembly can be coupled to the base assembly and the fan device can be operated as a pedestal-style fan device. In a second configuration, the fan head assembly can be decoupled from the base assembly and the fan head device can be positioned away from the base assembly. The fan head assembly can include multiple power sources to enable continuous operation while decoupled from the base assembly. Further, recoupling the fan head assembly to the base assembly can be performed more easily and efficiently because of a self-aligning receiving portion provided in the base assembly. The receiving portion of the base assembly can engage attachment features on the fan head assembly to slidably and rotatably couple the fan head assembly into a secure position on the base assembly with minimal user effort. As a result, the fan device herein can expand the number of locations for which the device can be used and can secure the fan head assembly to the base assembly in proper alignment in hands-free manner.

Figure 1B:
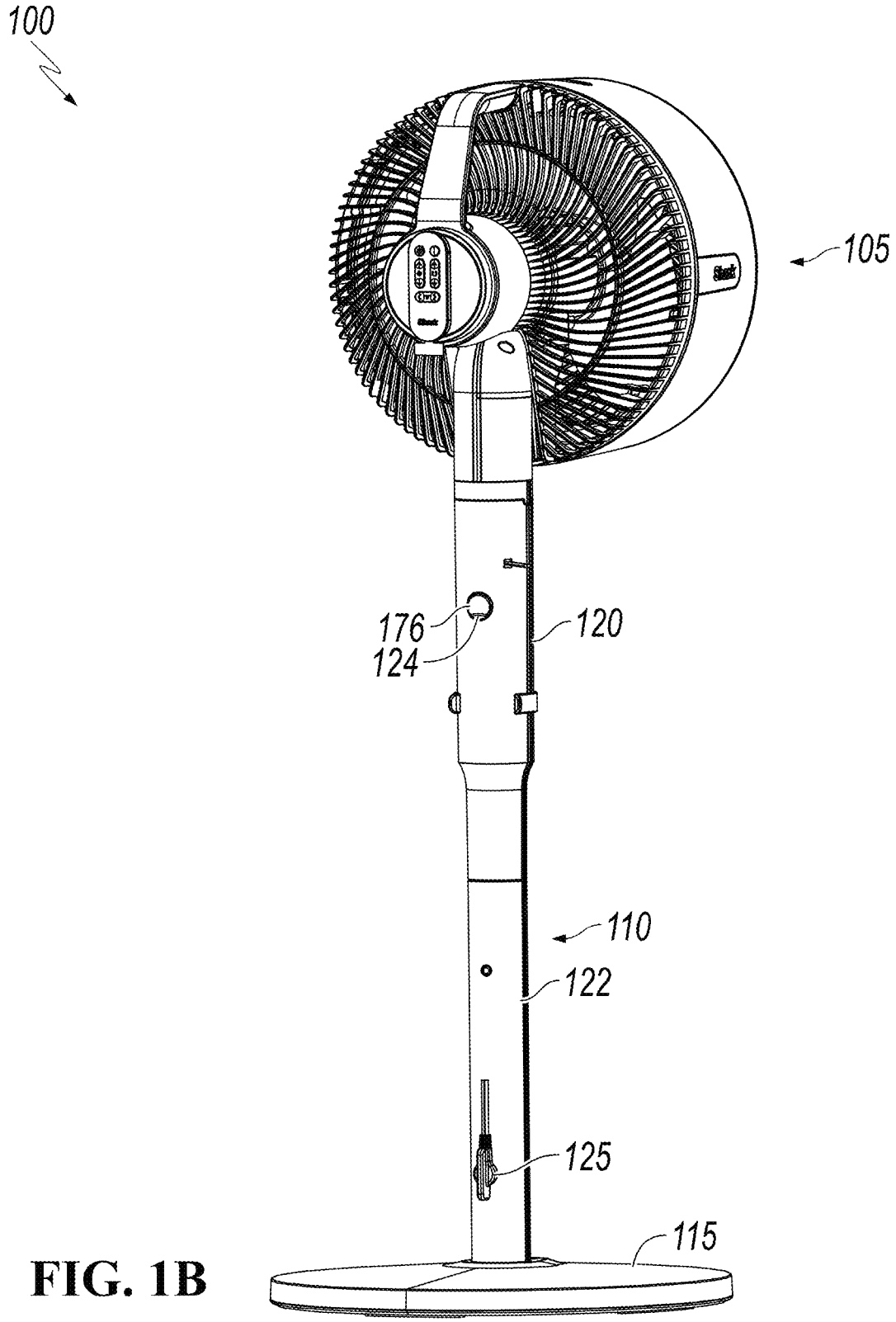
FIG. 1B is a rear perspective view of the fan device of FIG. 1.

FIGS. 1A and 1B illustrate one embodiment of a fan device 100 having a fan head assembly 105 and a base assembly 110. The head assembly 105 can be detachably coupled to the base assembly 110. The base assembly 110 includes a base 115, a housing 120, and a support 122 extending from the base 115. The housing 120 can include an opening 124 configured to receive an attachment mechanism 176 of the head assembly 105. The support 122 can include a power supply 125. In some embodiments, the power supply 125 can be a DC power supply and can include an electrical connector or jack. The DC power supply can be provided via a charging device configured to receive an AC power supply at a first side and generate the DC power supply at a second side, e.g., at the electrical connector of the power supply 125. The charging device can include an electromagnetic compatibility (EMC) enclosure including a printed circuit board therein. The printed circuit board can include an AC/DC converter configured to generate DC power based on the received AC power. When the head assembly 105 is coupled to the base assembly 105 in a first configuration shown in FIGS. 1A and 1B, the head assembly 105 can receive power via the power supply 125 provided in the support 122 of the base assembly 110.

Figure 2:
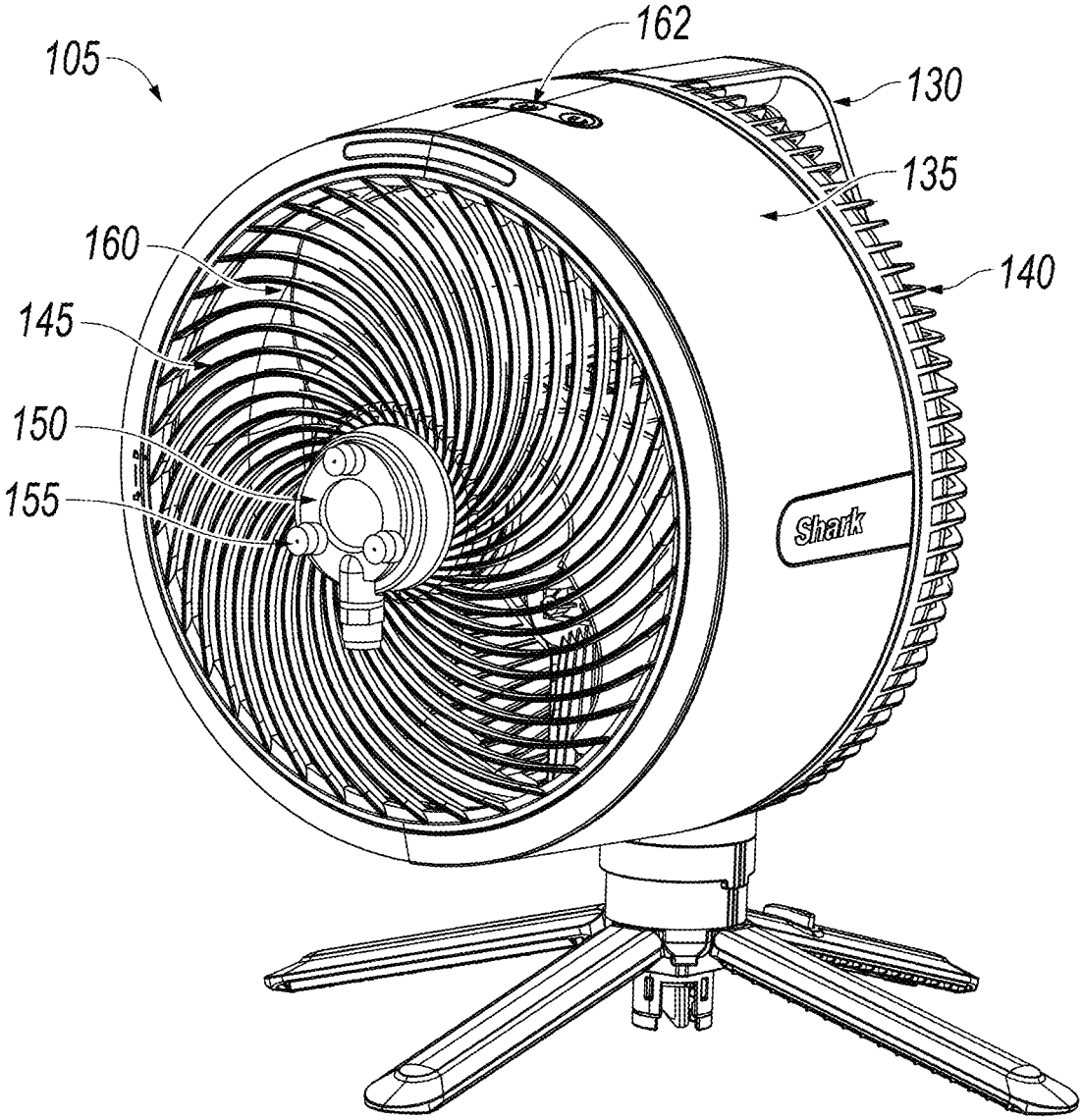
FIG. 2 is a perspective front view of a detachable head assembly of the fan device of FIGS. 1A and 1B shown having a plurality of legs in an extended position.
Figure 3:
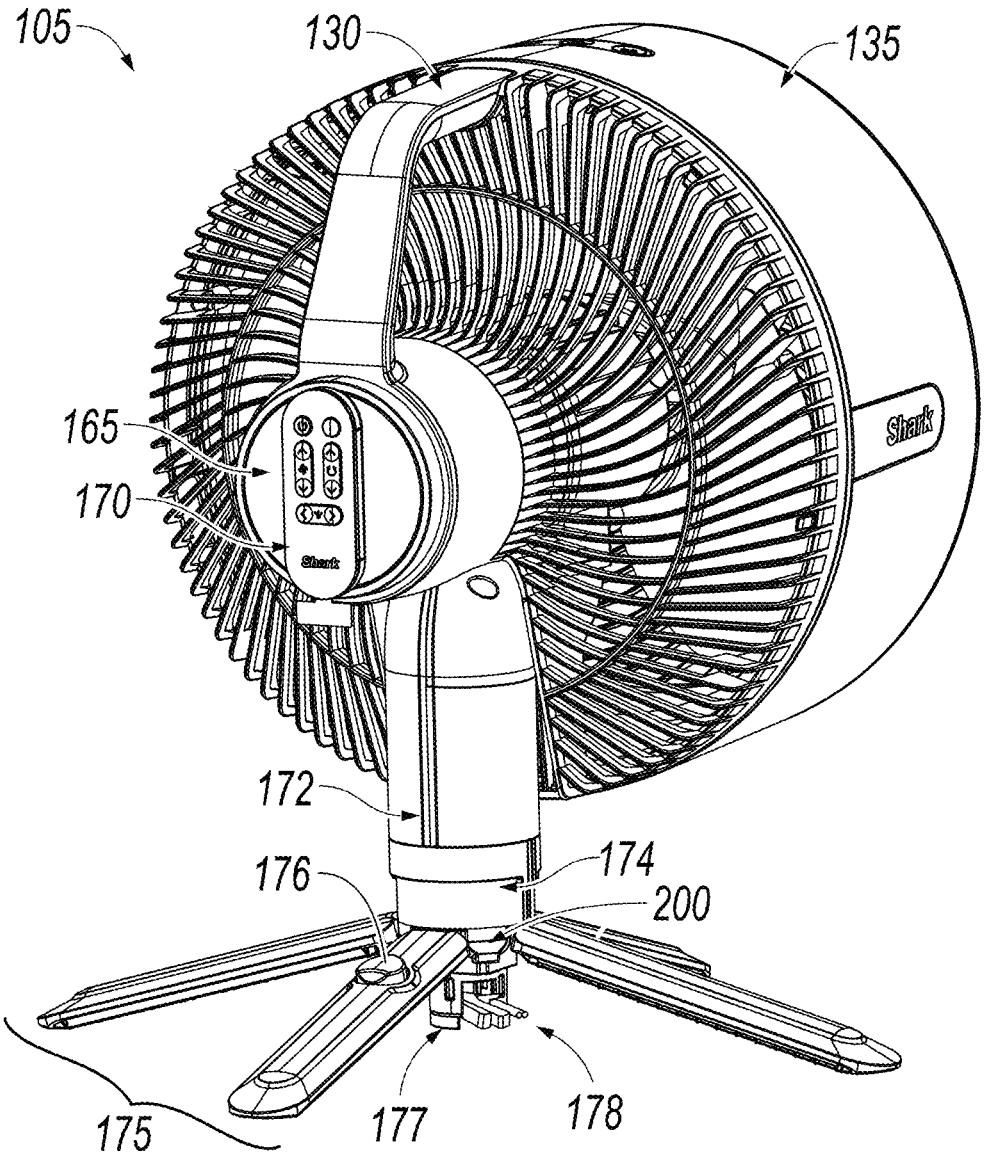
FIG. 3 is perspective rear view of the detachable head assembly of FIG. 2.
Figure 4:
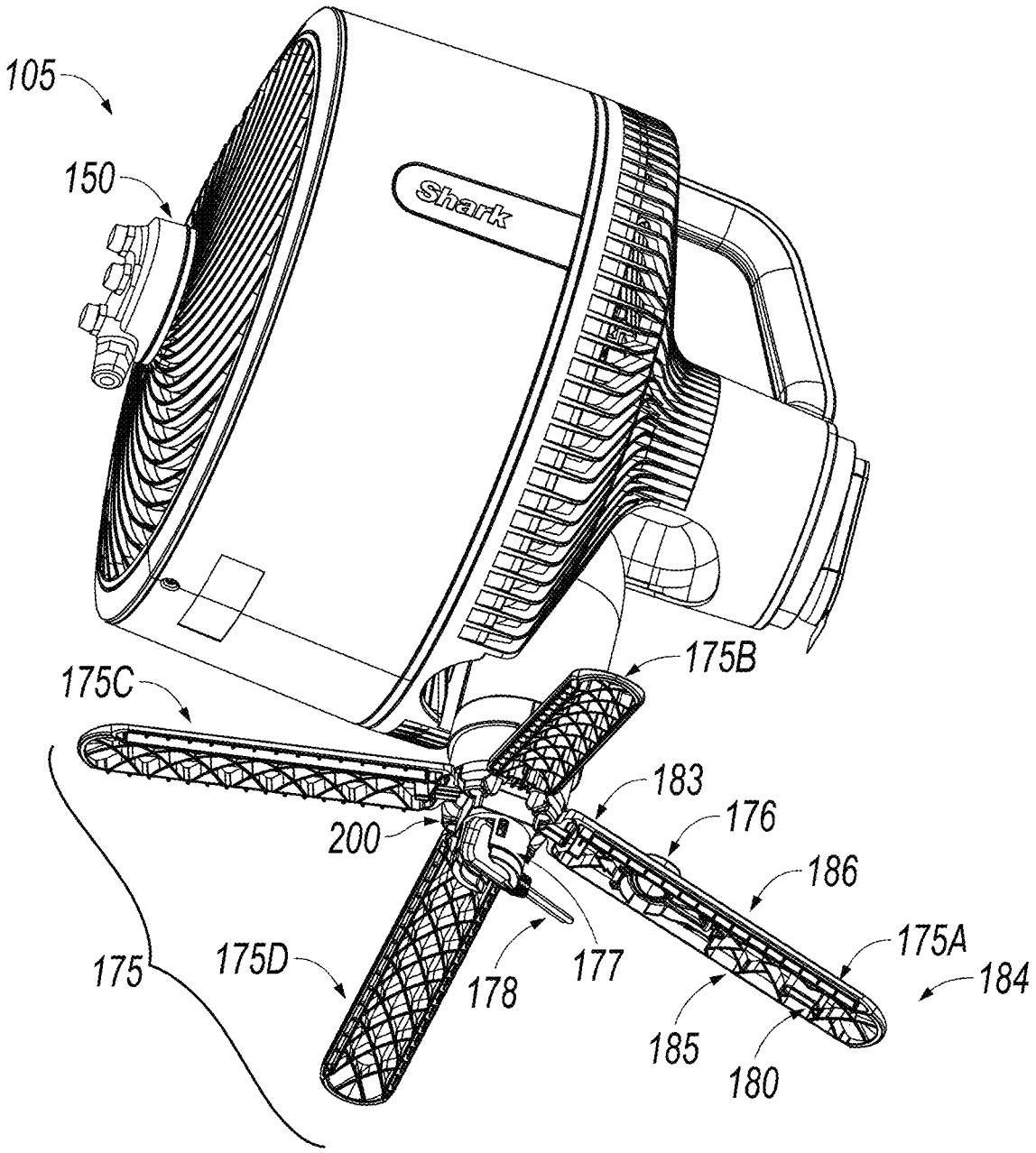
FIG. 4 is a perspective bottom view of the detachable head assembly of FIG. 2.

In a second configuration, shown in FIGS. 2-4, the head assembly 105 can be decoupled from the base assembly 105 and can operate as a free-standing unit separately from the base assembly 105. The head assembly 105 can include a handle 130, a cylindrical front housing 135, a rear grill 140, a front grill 145, and a detachable misting unit 150. The detachable misting unit 150 can include one or more outlets 155 configured to emit a vapor or mist from a fluid received from a fluid source coupled to the detachable misting unit 150. The head assembly 105 also includes a fan 160 arranged within the housing 135. A user interface 162 can be provided within the housing 135 in an easily viewable location. The user interface 162 can include a plurality of user input mechanisms configured to receive user inputs and control operation, such as power, oscillation settings, fan speed, or misting of the head assembly 105 and/or the fan device 100.

Figure 5:
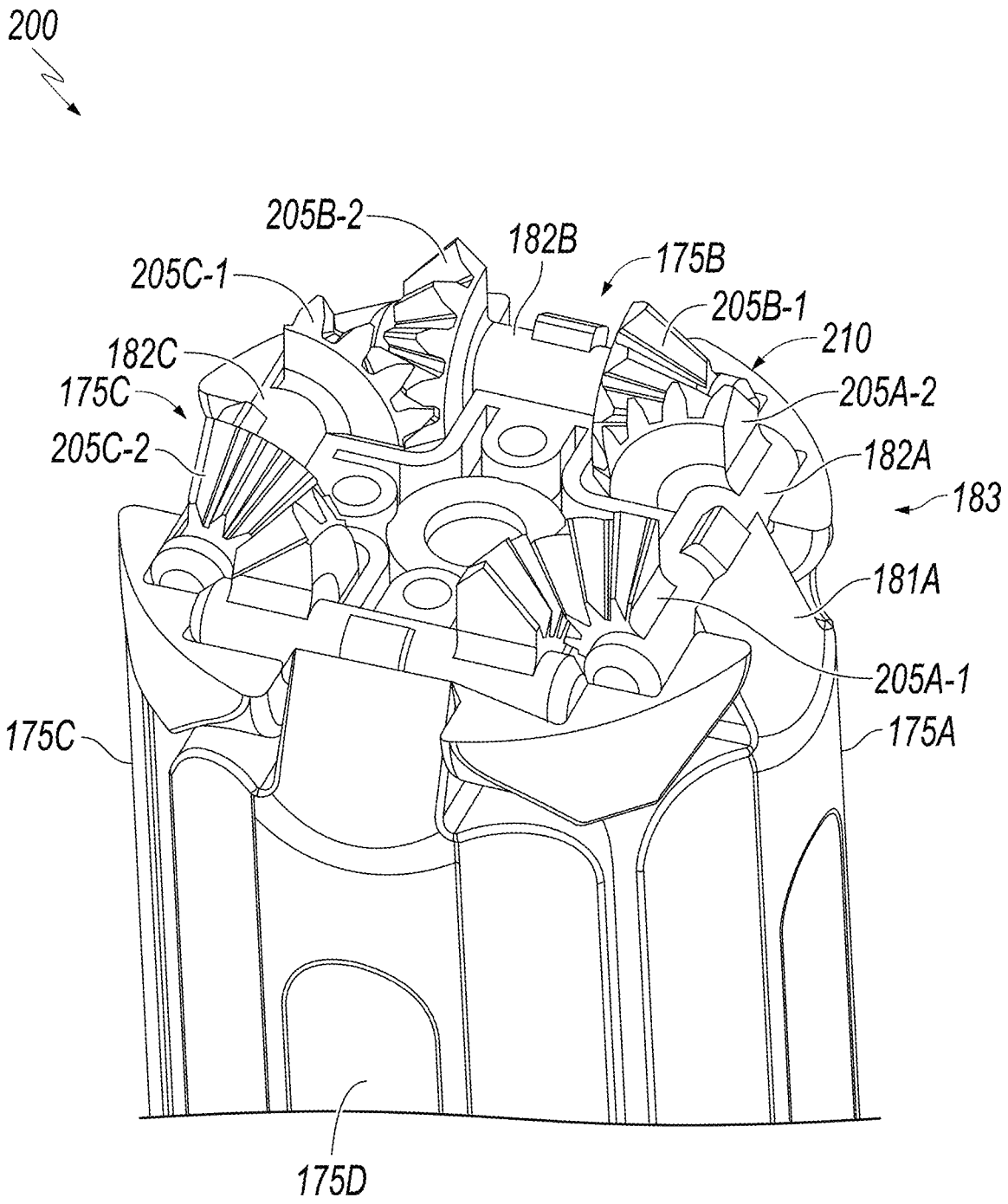
FIG. 5 is a perspective view of an articulation mechanism of the detachable head assembly of FIG. 2.
Figure 10:
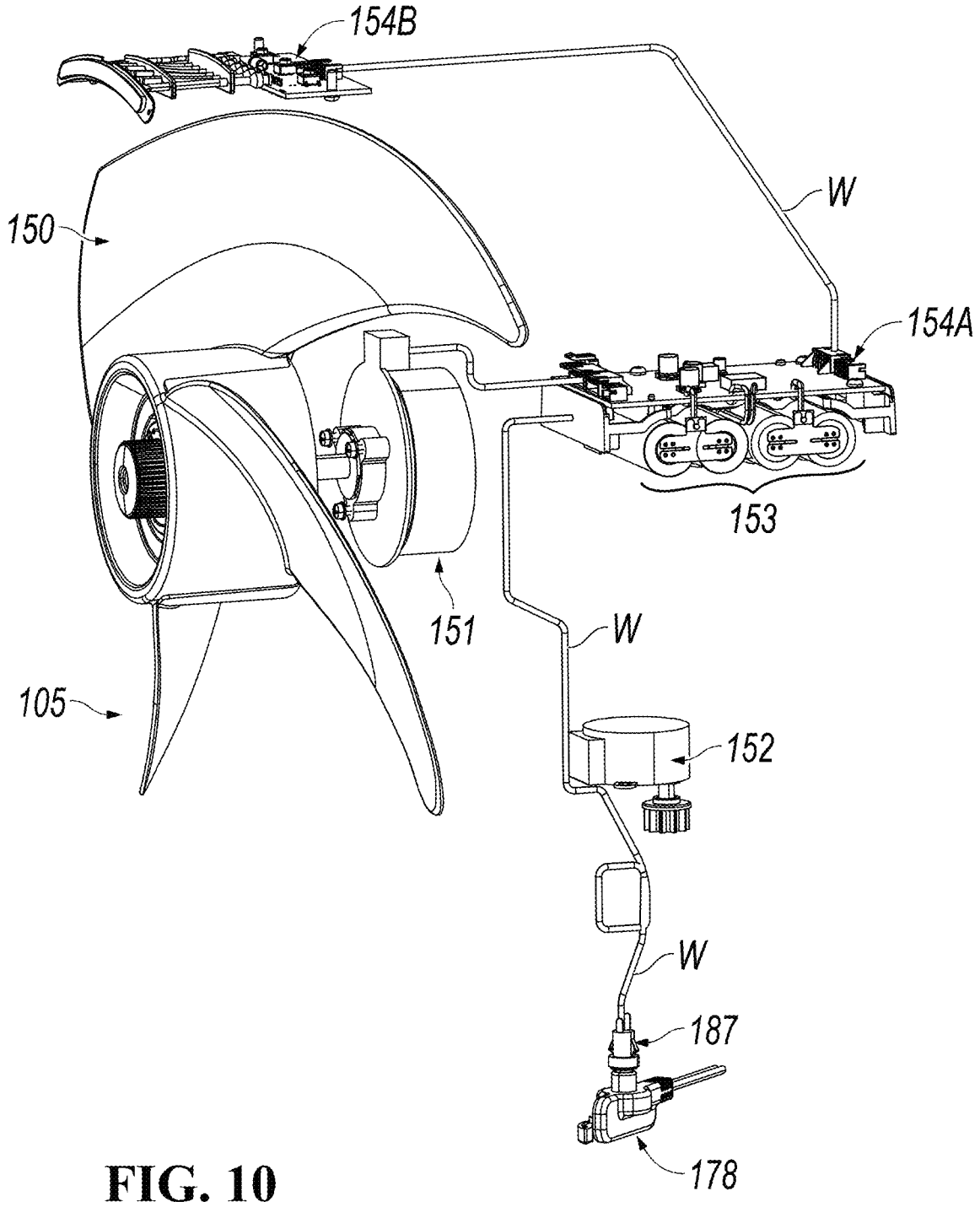
FIG. 10 is a perspective view of the detachable head assembly of FIGS. 1A-4.

The rear housing 165 can protrude from the rear grill 140 and can provide a detachable remote control unit 170 as shown in FIG. 3. The remote control unit 170 can include a plurality of user input mechanisms configured to receive user inputs and control operation, such as power, oscillation settings, fan speed, or misting of the head assembly 105 and/or the fan device 100. A head assembly support 172 can couple the rear housing 165 to an oscillation unit 174 configured to rotate the head assembly 105 relative to a plurality of legs 175. The oscillation unit 174 can include an oscillation motor 152 as shown in FIG. 10. The oscillation unit 174 can be positioned in the head assembly support 172 and atop an articulation mechanism 200 to which the plurality of legs 175 can be coupled as shown in FIGS. 3-5. A power supply housing 177 and a power supply 178 can be arranged beneath the articulation mechanism 200. In some embodiments, the power supply 178 can be a DC power supply and can include an electrical connector or jack. The DC power supply can be provided via a charging device configured to receive an AC power supply at a first side and generate the DC power supply at a second side, e.g., at the electrical connector of the power supply 178. The charging device can include an electromagnetic compatibility (EMC) enclosure including a printed circuit board therein. The printed circuit board can include an AC/DC converter configured to generate DC power based on the received AC power. When the head assembly 105 is decoupled from the base assembly 105 in the second configuration shown in FIGS. 2-4, the head assembly 105 can receive power via the power supply 178 provided in the power supply housing 177.

In some embodiments, the head assembly 105 can include 3, 4, 5, 6, or 7 legs. In the embodiment shown herein, the head assembly includes 4 legs, for example legs 175A-175D, as shown in FIGS. 4-5. At least one leg, such as leg 175A, can include an attachment mechanism 176 provided on an exterior surface 186 of leg 175. The attachment mechanism 176 can include a protrusion or button that can be received within opening 124 of the housing 120 when the head assembly 105 is coupled to the base assembly 110. The attachment mechanism 176 can be coupled to an actuation mechanism 179 configured to cause the attachment mechanism 176 to be movably provided through an opening in the leg 175A.

Figure 6:
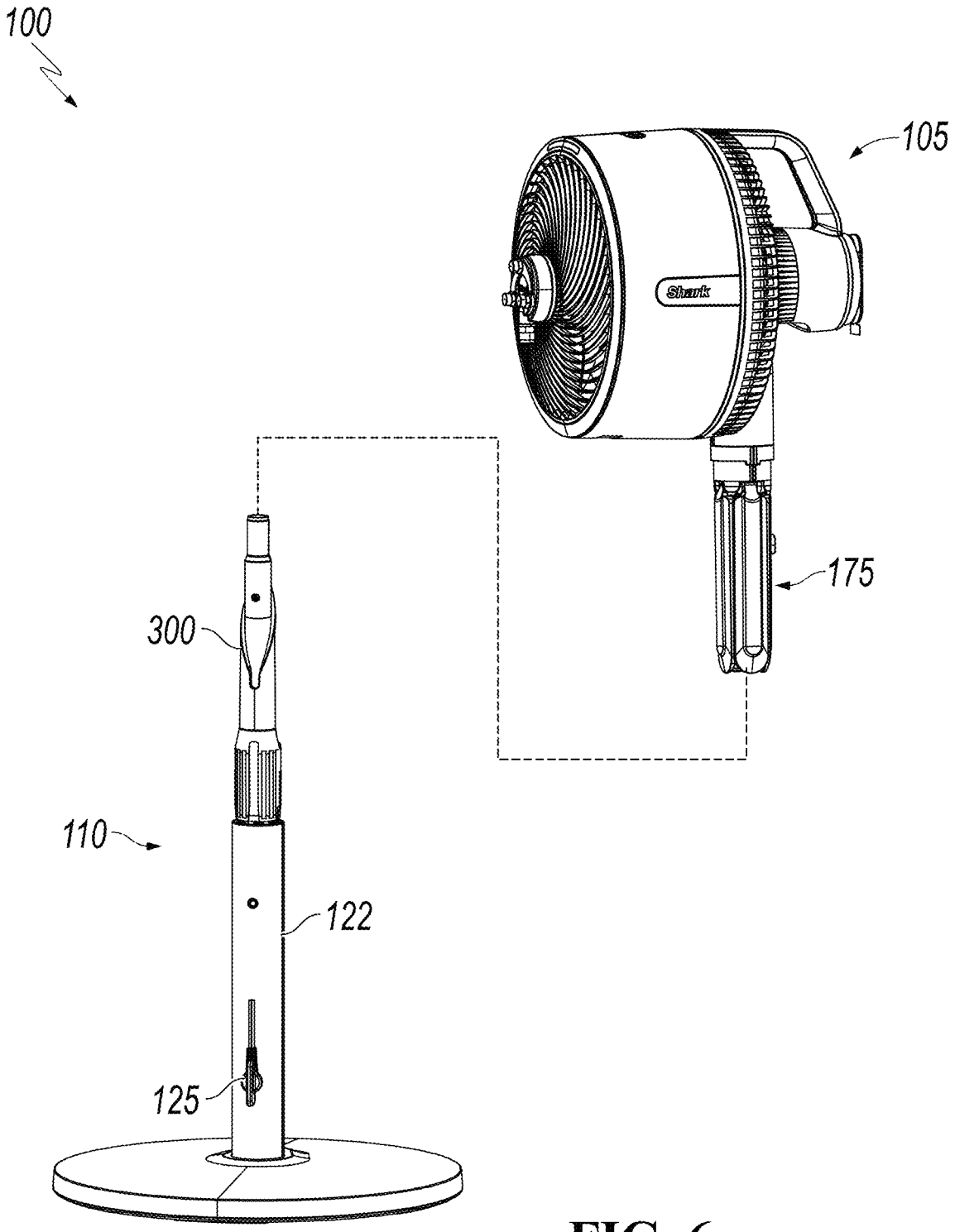
FIG. 6 is an exploded perspective view of the detachable head assembly decoupled from a receiving portion of the base assembly of the fan device of FIGS. 1A and 1B.

The articulation mechanism 200 can enable the plurality of legs 175 to translate together, in unison, when translating from a folded position, as shown in FIG. 6, when the head assembly 105 is coupled to the base assembly 110 or initially decoupled from the base assembly 110, to an extended position, as shown in FIGS. 2-4, when the head assembly 105 has been decoupled from the base assembly 110 and the legs have been opened from their folded position. The articulation mechanism 200 can include a plurality of interconnected gears 205 as shown in FIG. 5. The gears 205 can cause the legs 175 to articulate synchronously, such that when one leg 175 is translated between stowed and extended positions (or vice versa), the remainder of the legs 175 articulate cooperatively in unison with the translated leg. In this way, extending the legs 175 between the folded and extended positions is easier and articulating individual legs is not required.

The gears 205 of the articulation mechanism 200 can be provided at first end of each leg 175. The first end 183 of each leg is adjacent to the power supply housing 177 and opposite to the second end 184 as shown in FIG. 4. The first end 183 of each leg 175 can include a neck portion 181 that can be integrally formed with a cylindrical cross-member 182. At each end of the cross-member 182 a gear 205 can be provided. For example, as shown in FIG. 5, leg 175A can include gears 205A-1 and 205A-2 at terminal ends of the cross-member 182A. A second adjacent leg 175B can include gears 205B-1 and 205B-2 arranged at terminal ends of its respective cross-member 182B. Gear 205A-2 of leg 175A can engage with gear 205B-1 of leg 175B. Similarly, gear 205B-2 of leg 175B can engage with gear 205C-1 of leg 175C. The neck portions 181, cross-members 182, and gears 205 can be arranged within a frame 210 as shown in FIG. 5. The frame 210 can house the first end 183 of the legs 175 to enable the gears 205 of adjacent legs 175 to fold or extend in unison.

Returning to the base assembly 110, as shown in FIG. 6, a receiving portion 300 can be coupled to the support 122 to facilitate coupling with the head assembly 105. As shown in FIG. 6, the housing 120 has been removed for clarity. The receiving portion 300 can be an elongate member with a plurality of attachment features configured to couple with and secure the head assembly 105. The plurality of legs 175 can form a cavity therein along the length of the legs 175 when the legs 175 are arranged in the folded position as shown in FIG. 6. The head assembly 105 can couple to the receiving portion 300 such that the plurality of legs 175 can be positioned atop the receiving portion 300 and can slide down onto the receiving portion 300. Attachment features on the legs 175, such as the protrusion 180 shown in FIGS. 4 and 8, can engage with attachment features on the receiving portion 300 to allow the head assembly 105 to couple with the base assembly 110.

Figure 7A:
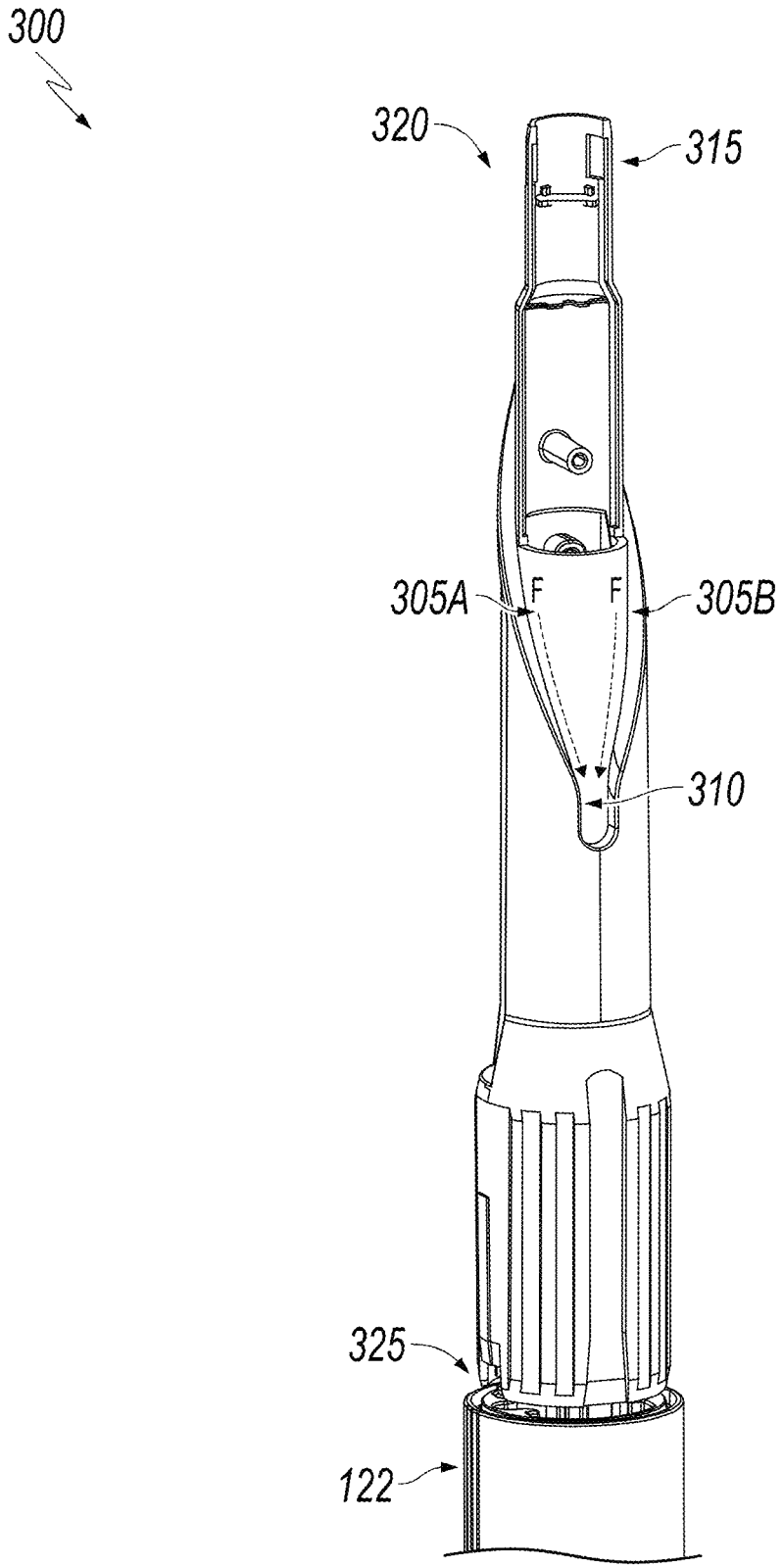
FIG. 7A is a front view of the receiving portion of FIG. 6.
Figure 7B:
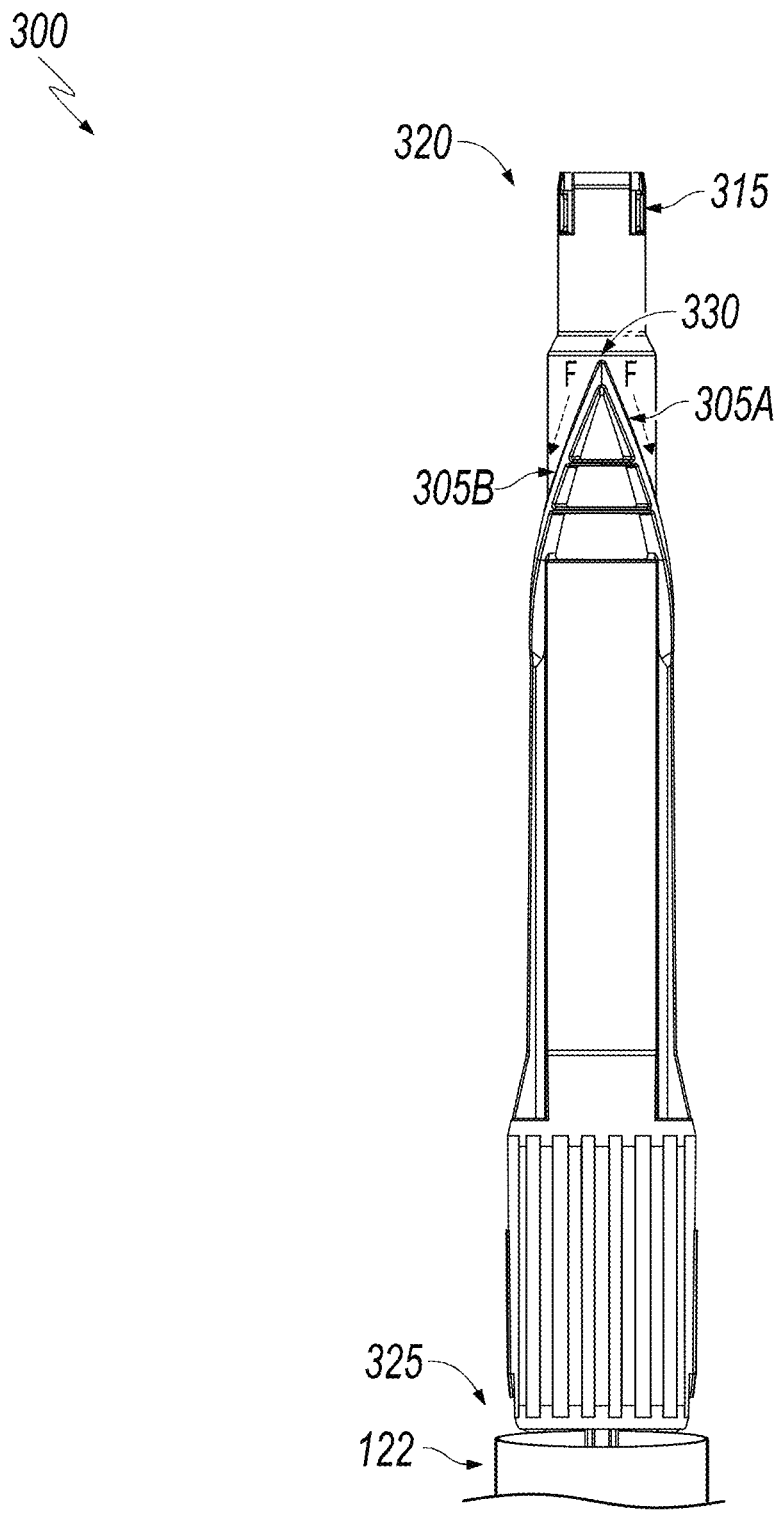
FIG. 7B is a rear view of the receiving portion of FIG. 6.
Figure 8:
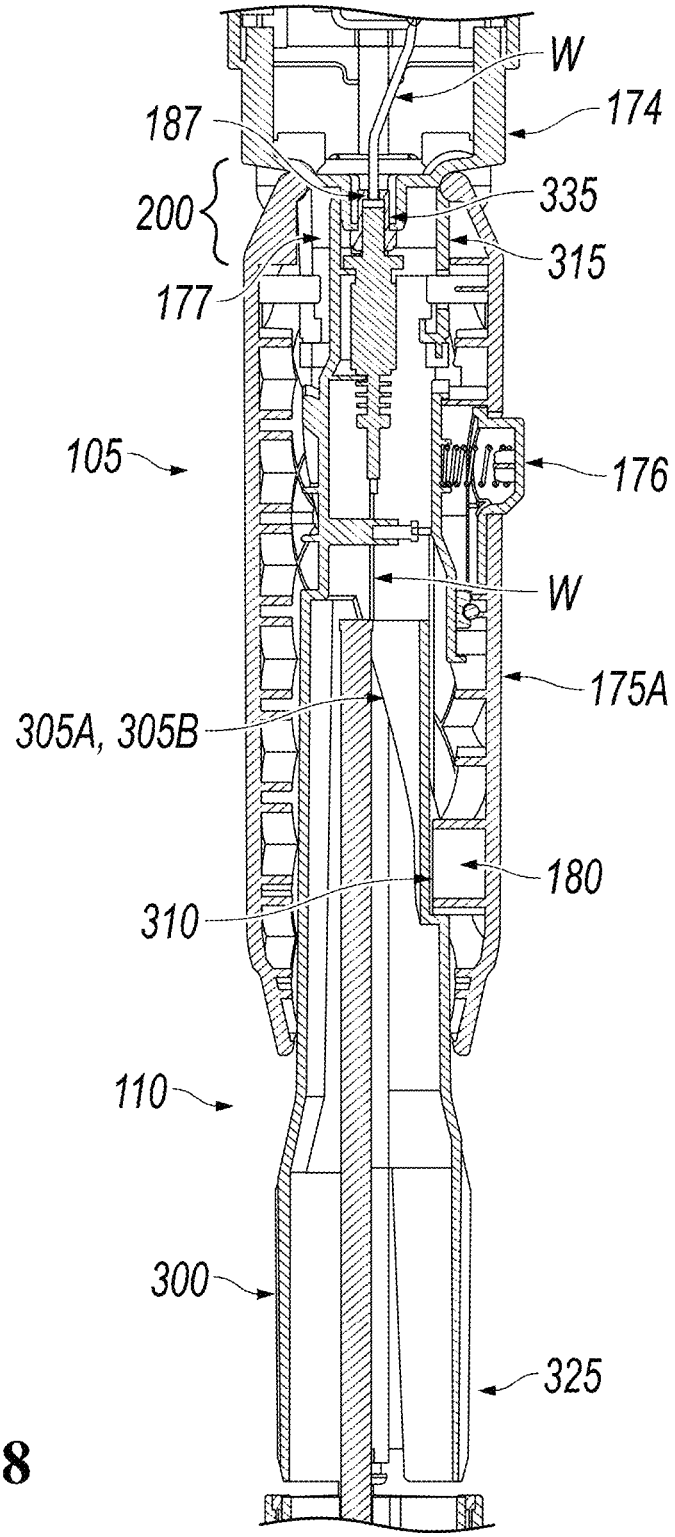
FIG. 8 is a cross-sectional view of legs of the detachable head assembly coupled to the receiving portion of the base assembly of the fan device of FIGS. 1A and 1B.

The attachment features of the receiving portion 300 can be seen in FIGS. 7A-7B and 8. The receiving portion 300 can have an elongate shape extending between a first end 320 and a second end 325. A pair of opposing surfaces 305 can extend from the first end 320 of the receiving portion 300 toward the second end 325. The pair of opposing surfaces 305 can have a substantially spiral-shape extending around the receiving portion 300. The pair of opposing surfaces 305 can extend from a first side of the receiving portion 300 shown in FIG. 7B toward a notch 310 on a second side of the receiving portion 300 shown in FIG. 7A. The pair of opposing surfaces 305 can form a guide path F therebetween.

The protrusion 180 provided on an inferior surface 185 of leg 175A as shown in FIG. 4 can be received between the pair of opposing surfaces 305 and can translated along the guide path F into the notch 310 when the head assembly 105 is coupled to the receiving portion 300. The pair of opposing surfaces 305 can extend from an apex 330 adjacent to the first end 320 of the receiving portion 300. The apex 330 can cause the protrusion 180 to translate in a first rotational direction along surface 305A or a second rotational direction along surface 305B. In this way, regardless of the orientation of the head assembly 105 when initially coupled with the base assembly 110, the protrusion 180 on at least one of the legs 175 can engage with either of the opposing surfaces 305 and can be guided downward along the guide path F into a secure position within the notch 310 without requiring a user to manually secure the head assembly 105 to the base assembly 110. In the cross-sectional view shown in FIG. 8 of the head assembly 105 coupled to the base assembly 110, the protrusion 180 of leg 175A can be viewed within the notch 310 after having traveled along either of the opposing surfaces 305A or 305B.

Figure 9A:
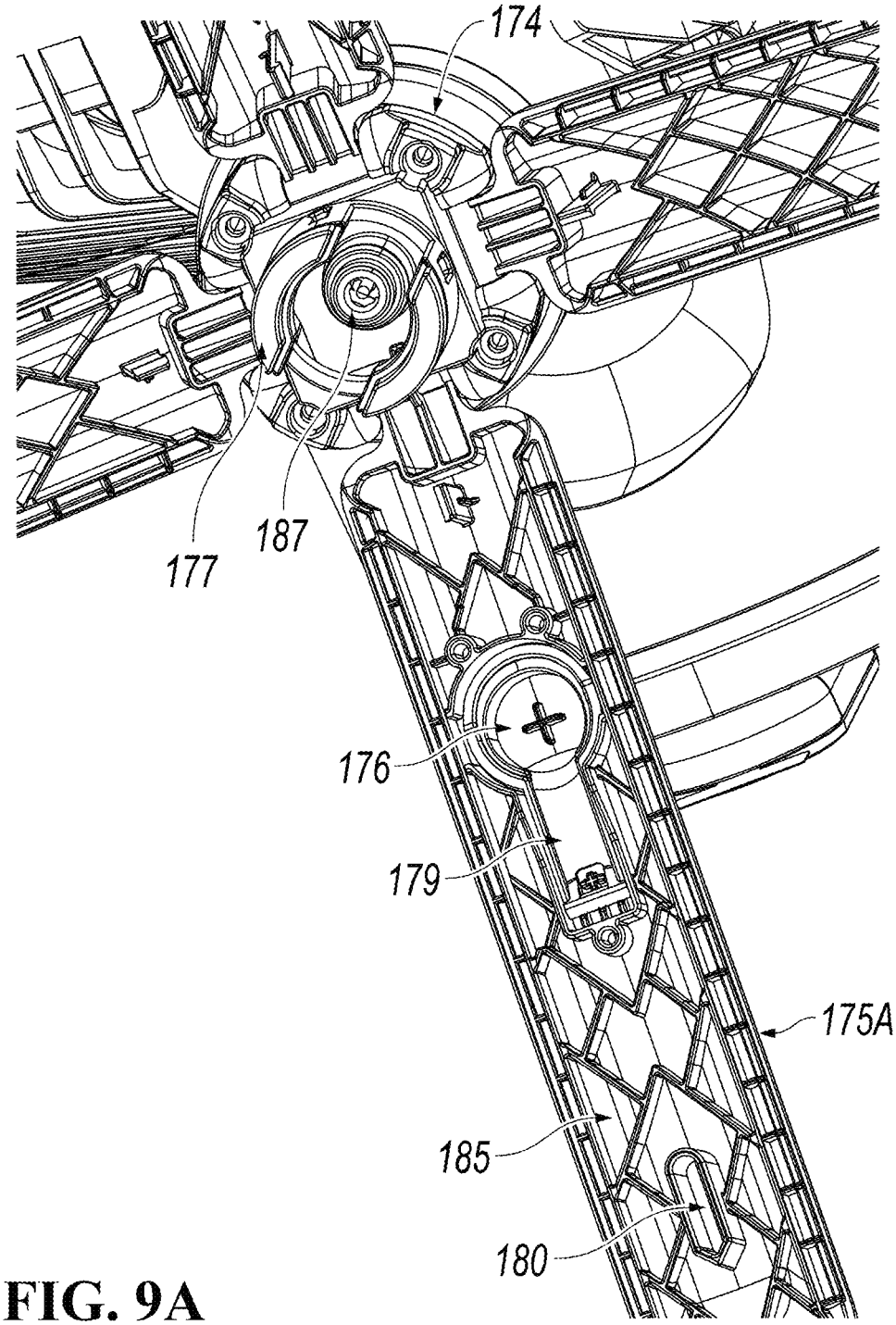
FIG. 9A is a perspective bottom view of a portion of the detachable head assembly of FIGS. 1A-4 and 6.
Figure 9B:
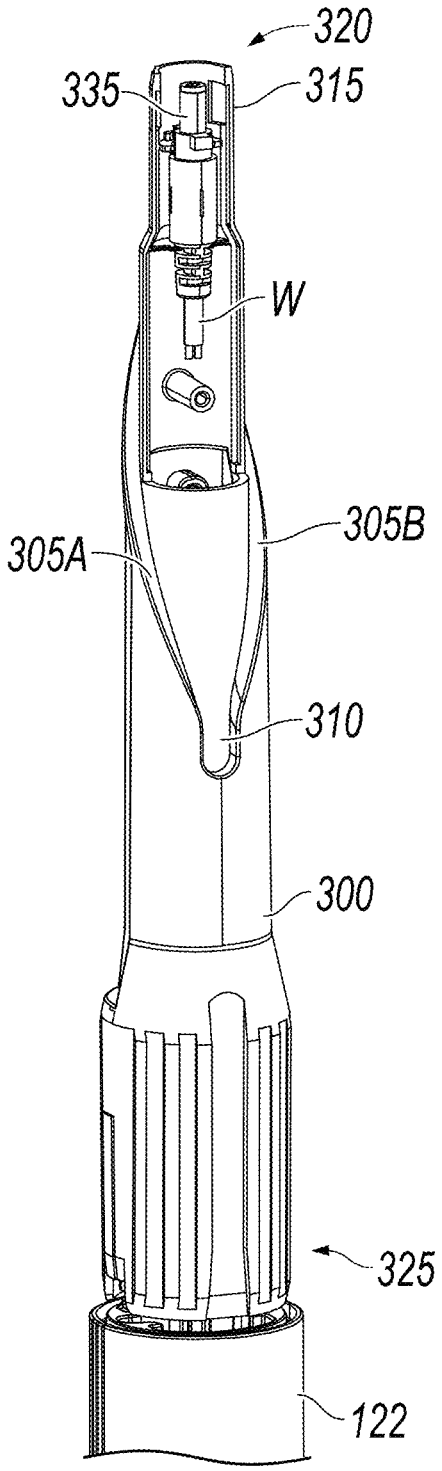
FIG. 9B is a perspective view of the receiving portion of FIGS. 6-8.

The head assembly 105 can be electrically coupled to the base assembly 110 by respective electrical connectors provided in the head assembly 105 and the base assembly 110. As shown in FIGS. 8 and 9A-9B, the head assembly 105 can include a first electrical connector 187 provided within the power supply housing 177. The first electrical connector 187 can be configured as male connector that can be received within a second electrical connector 335 provided at the first end 320 of the receiving portion 300. The second electrical connector 335 can be a female connector. In some embodiments, the first electrical connector 187 can be configured as a female connector and the second electrical connector 335 can be configured as a male connector. When power supply housing 315 of the receiving portion 300 is engaged within the power supply housing 177 of the head assembly 105, the first electrical connector 187 can be received within the second electrical connector 335. In this way, the head assembly 105 can receive power via the power supply 125 provided in the support 122 of the base assembly 110 when the head assembly 105 is received upon and coupled to the receiving portion 300 of the base assembly 110. Wiring W can couple the second electrical connector 335 to the power supply 125.

The head assembly 105 can also receive power via the first electrical connector 187 when the head assembly 105 is decoupled from the base assembly 110. As shown in FIG. 10, the power supply 178 can be coupled to the first electrical connector 187 to provide power to components of the head assembly 105. For example, the wiring W can receive power from the first electrical connector 187 and provide power to the oscillation motor 152, the fan motor 151, the rechargeable batteries 153, and electrical components such as printed circuit boards 154. Printed circuit board 154A can be configured to control operation of the fan motor 151 or the oscillation motor 152, as well as charging operations for the rechargeable batteries 153. The printed circuit board 154B can be communicatively coupled to the user interface 162 and to the printed circuit board 154A to convey user inputs received via the user interface 162 to the printed circuit board 154A. The provision of the rechargeable batteries 153 enables the head assembly 105 to be operated in a stand-alone configuration that is separate from the base assembly 110 and is not connected to the power supply 178. Alternatively, the power supply 178 can be coupled to the first electrical connector 187 in the stand-alone configuration to charge the batteries 153 and provide power to the head assembly 105.

Embodiments of the fan device described herein produce several advantages. For example, the arrangement of pair of opposing surfaces 305 relative to the protrusion 180 on one of the legs 175 enables the head assembly 105 to be easily coupled to and aligned with the base assembly 110 with minimal user intervention or manipulation. Further, the provision of multiple power supplies, such as power supplies 125, 178 and rechargeable batteries 153 can facilitate powered operation of the fan device 100 in configurations in which the head assembly 105 is coupled and uncoupled to the base assembly 110. As a result, the fan device provides improved usability in a variety of configurations which are not available in existing fan devices with fixed coupling between a head assembly and base assembly.

Certain exemplary embodiments have been described to provide an overall understanding of the principles of the structure, function, manufacture, and use of the systems, devices, and methods disclosed herein. One or more examples of these embodiments have been illustrated in the accompanying drawings. Those skilled in the art will understand that the systems, devices, and methods specifically described herein and illustrated in the accompanying drawings are non-limiting exemplary embodiments and that the scope of the present invention is defined solely by the claims. The features illustrated or described in connection with one exemplary embodiment may be combined with the features of other embodiments. Such modifications and variations are intended to be included within the scope of the present invention. Further, in the present disclosure, like-named components of the embodiments generally have similar features, and thus within a particular embodiment each feature of each like-named component is not necessarily fully elaborated upon.

Approximating language, as used herein throughout the specification and claims, may be applied to modify any quantitative representation that could permissibly vary without resulting in a change in the basic function to which it is related. Accordingly, a value modified by a term or terms, such as "about," "approximately," and "substantially," are not to be limited to the precise value specified. In at least some instances, the approximating language may correspond to the precision of an instrument for measuring the value. Here and throughout the specification and claims, range limitations may be combined and/or interchanged, such ranges are identified and include all the sub-ranges contained therein unless context or language indicates otherwise.

One skilled in the art will appreciate further features and advantages of the invention based on the above-described embodiments. Accordingly, the present application is not to be limited by what has been particularly shown and described, except as indicated by the appended claims. All publications and references cited herein are expressly incorporated by reference in their entirety.

The invention claimed is:

1. A fan comprising:

a head assembly having a fan and a motor operatively coupled to the fan, the head assembly including an articulation mechanism and a plurality of legs coupled to the articulation mechanism; and a base assembly detachably coupled to the head assembly, the base assembly having a base and a support with a first end coupled to the base and a second end opposite the first end, the support including a housing and an elongate receiving portion arranged within the housing at the second end of the support, the plurality of legs being removably received within the receiving portion.

2. The fan of claim 1, wherein the head assembly includes at least one of a rechargeable battery and a first DC power supply and the base assembly includes a second DC power supply.

3. The fan of claim 2, wherein the second DC power supply is configured to provide power to the head assembly when the head assembly is coupled to the base assembly.

4. The fan of claim 1, wherein the receiving portion comprises a pair of opposing surfaces forming a guide path there between extending from the first end toward a notch at a second end of the receiving portion.

5. The fan of claim 4, wherein a first surface of the pair of opposing surfaces is oriented in a first rotational direction configured to cause the head assembly to rotate in the first rotational direction when the head assembly is coupled to the base assembly, and a second surface of the pair of opposing surfaces is oriented in a second rotational direction, opposite the first rotational direction, the second surface configured to cause the head assembly to rotate in the second rotational direction when the head assembly is coupled to the base assembly.

6. The fan of claim 4, wherein at the least one leg of the plurality of legs includes a protrusion thereon configured to translate along at least one surface of the pair of opposing surfaces in the guide path causing the protrusion to be received within the notch.

7. The fan of claim 1, wherein the at least one leg of the plurality of legs includes an attachment mechanism removably received within an opening of the housing.

8. The fan of claim 1, wherein the plurality of legs comprises 3, 4, or 5 legs.

9. The fan of claim 1, wherein the articulation mechanism includes a plurality of gears configured to cause the plurality of legs to actuate in unison from a stored position to an extended position.

10. The fan of claim 1, wherein the head assembly further includes a detachable misting unit.

11. A fan comprising:

a fan head detachably coupled to a base assembly, the fan head including a plurality of fan blades, a motor operatively coupled to the plurality of fan blades, and an articulation mechanism including a first electrical connector therein and a plurality of legs configured to move between a folded position and an extended position, the base assembly including an elongate support member having a first end coupled to a base and a second end, opposite the first end, having a receiving portion configured to receive the articulation mechanism and including a second electrical connector therein coupled to the first electrical connector.

12. The fan of claim 11, further comprising a third electrical connector positioned in the elongate support member and configured to provide power to the first and second electrical connectors when the fan head is attached to the base assembly.

13. The fan of claim 11, wherein the first electrical connector is configured to receive power via a fourth electrical connector of an AC power supply or via one or more rechargeable batteries within the fan head when the fan head is detached from the base assembly.

14. The fan of 11, further comprising an oscillating unit coupling the fan head to the articulation mechanism, the oscillating unit configured to rotate the fan head about a longitudinal axis extending through a fan head support of the fan head.

15. The fan of claim 11, wherein the fan head further includes a user interface positioned atop a cylindrical housing of the fan head and a remote control unit detachably coupled to the fan head.

16. The fan of claim 11, wherein the receiving portion comprises a pair of opposed surfaces extending circumferentially therearound and extending from a first end of the receiving portion at which the articulation mechanism is receive toward the base, the pair of opposed surfaces forming a guide path for the fan head to translate vertically onto the elongate support member.

17. The fan of claim 11, wherein the elongate support member includes a cylindrical housing opposite the base, the plurality of legs positioned over the receiving portion and within the cylindrical housing when the fan head is coupled to the base assembly.

18. The fan of claim 11, wherein the plurality of legs are configured to move in unison between the folded position and the extended position.

19. The fan of claim 11, wherein the articulation mechanism comprises a plurality of inter-connected gears coupling the plurality of legs.

20. The fan of claim 19, wherein each leg of the plurality of legs includes a cylindrical cross-member received within a frame of the articulation mechanism and including a pair of gears disposed on opposite ends of the cylindrical cross-member to engageably couple gears of adjacent legs within the articulation mechanism.

* * * * *